US005209204A

United States Patent [19]

Bodenhausen et al.

[11] Patent Number: 5,209,204

[45] Date of Patent: May 11, 1993

[54] FUEL DISTRIBUTOR FOR A FUEL INJECTION VALVE

[75] Inventors: Eckhard Bodenhausen, Steinheim; Klaus-Juergen Peters, Affalterbach-Birkhau, both of Fed. Rep. of Germany

[73] Assignee: Robert Bosch GmbH, Stuttgart, Fed. Rep. of Germany

[21] Appl. No.: 948,200

[22] Filed: Sep. 21, 1992

[30] Foreign Application Priority Data

Sep. 21, 1991 [DE] Fed. Rep. of Germany ..... 4131537

[51] Int. Cl.[5] ..... F02M 55/02

[52] U.S. Cl. ..... 123/470; 123/456

[58] Field of Search ..... 123/456, 468, 469, 470; 439/130

[56] References Cited

U.S. PATENT DOCUMENTS

| | | | |
|---|---|---|---|
| 4,844,036 | 7/1989 | Bassler et al. | 123/470 |
| 4,950,171 | 8/1990 | Muzlay | 123/470 |
| 5,016,594 | 5/1991 | Hafner et al. | 123/456 |
| 5,030,116 | 7/1991 | Sakai et al. | 123/470 |
| 5,046,469 | 9/1991 | Gmelin | 123/470 |
| 5,086,743 | 2/1992 | Hickey | 123/456 |
| 5,111,794 | 5/1992 | DeGrace, Jr. | 123/456 |
| 5,131,857 | 7/1992 | Gmelin et al. | 123/456 |

FOREIGN PATENT DOCUMENTS

| | | |
|---|---|---|
| 0374422 | 6/1990 | European Pat. Off. . |
| 4002393 | 8/1991 | Fed. Rep. of Germany . |

*Primary Examiner*—E. Rollins Cross
*Assistant Examiner*—Thomas Moulis
*Attorney, Agent, or Firm*—Edwin E. Greigg; Ronald E. Greigg

[57] ABSTRACT

A fuel distributor, including a plug connection which serves to provide electrical contact for the fuel injection valves comprising a socket and a plug. The plug connection that is located directly on the valve connection neck, in a region between two sealing elements, that seal off a connection between the fuel distributor and the fuel injection valve, so that the fuel-carrying region is sealed off from the guide conduit, which in turn is sealed off from external influences such as splashing water. Thus, even the plug connections located in the region of the guide conduit are protected. The fuel distributor is especially suitable for fuel injection systems of mixture-compressing internal combustion engines with externally supplied ignition.

5 Claims, 2 Drawing Sheets

FUEL DISTRIBUTOR FOR A FUEL INJECTION VALVE

BACKGROUND OF THE INVENTION

The invention is based on a fuel distributor for a fuel injection valve. From European Patent Document 0 374 422 Al, a fuel distributor is already known that has a number of connection necks, each for receiving one fuel injection valve, that corresponds to the number of cylinders of a mixture-compressing internal combustion engine with externally supplied ignition. The fuel distributor is divided into two conduits extending parallel to one another; one conduit serves to receive electrical lines and the other is designed as a fuel supply conduit.

Making electrical contact between the fuel injection valves and the fuel distributor is done by a plug connection that comprises a socket, integrated into the fuel distributor, and a plug disposed on an overhang of the fuel injection valve. The plug connection is only inadequately protected against external factors such as the penetration of splashing water, so that transmission of the electrical pulses arising from a control unit, which is necessary for proper function of the fuel injection valves, is threatened by premature corrosion of the plug connection.

Moreover, if the surfaces of the socket and plug become inseparably joined because of contact corrosion, then replacing the fuel injection valves, for instance in the course of repair work on the fuel injection system, becomes difficult.

OBJECT AND SUMMARY OF THE INVENTION

The fuel distributor according to the invention has an advantage over the prior art in that the parts of the electric plug connection that are especially sensitive to external influences such as splashing water are disposed at an especially protected location.

It is advantageous for the region in which the plug connection is located to be protected from external influences and from the fuel-carrying region by means of sealing elements.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
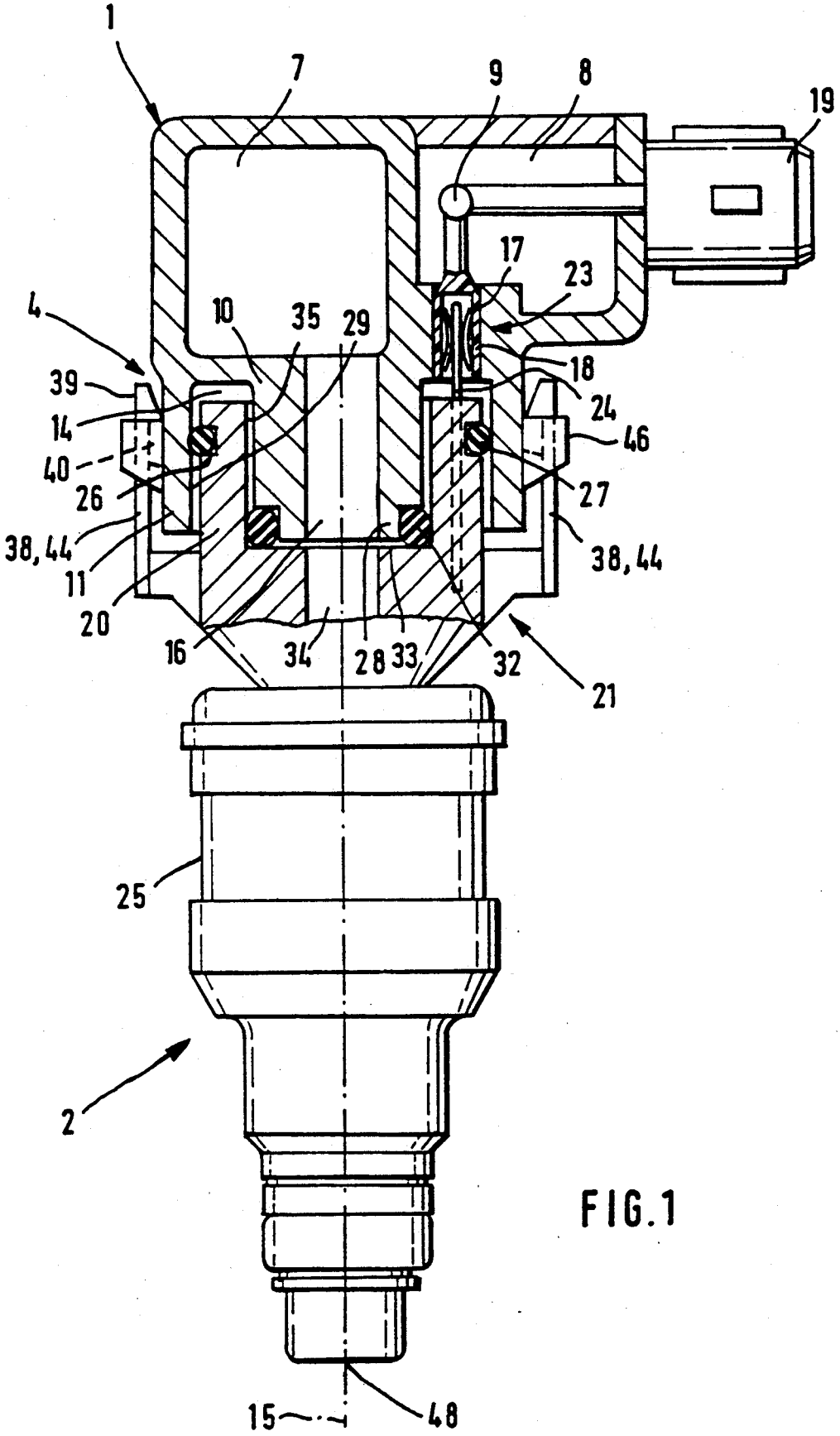
FIG. 1 is a partial sectional view through the fuel distributor in the region of one of the fuel injection valves.
Figure 2:
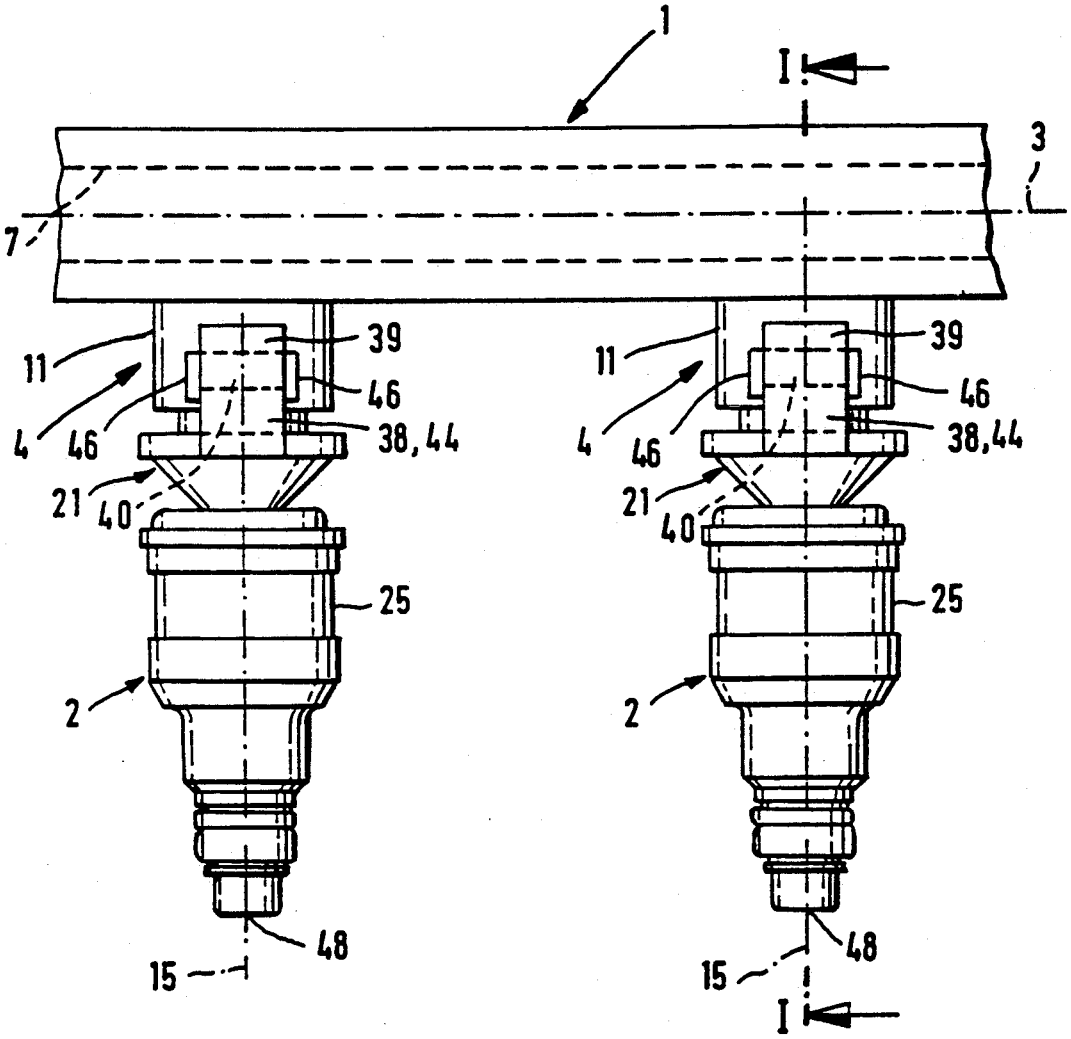
FIG. 2 is a fragmentary side view of a fuel distributor according to the invention, with two fuel injection valves.

FIGS. 1 and 2 show a fuel distributor 1, which is intended for fuel injection systems of mixture-compressing internal combustion engines with externally supplied ignition and is connected to a fuel supply line (not shown in further detail). The fuel distributor 1, for instance elongated in shape with a rectangular cross section, serves to supply fuel to at least two fuel injection valves 2; for receiving them, the fuel distributor 1 has a number of valve connection necks 4, for instance extending at right angles away from the fuel distributor 1, corresponding to the number of fuel injection valves 2 and located along a longitudinal distributor axis 3. The fuel injection valves 2 are inserted by one end into these connection necks 4. Extending parallel to a fuel conduit 7 is a guide conduit 8, which serves to receive electrical lines 9. The various fuel injection valves 2 are supplied with fuel through the fuel conduit 7 of the fuel distributor 1. The fuel injection valves 2 are controlled by a known electronic control unit, now shown, which is electrically connected to the various fuel injection valves via the lines 9.

In the region of each of the valve connection necks 4, the fuel distributor 1 has two coaxial tubular branches 10, 11, for instance of circular cross section, located one inside the other and extending at right angles to the longitudinal axis 3 of the distributor. The inside diameter of the branch 11 is larger than the outside diameter of the inner branch 1, so that the two branches 10, 11 together form an annular chamber 14 extending coaxially with a longitudinal valve axis 15 and at right angles, for instance, to the longitudinal distributor axis 3. The annular chamber 14 is open on the side toward the fuel injection valve 2 and closed on the side away from the fuel injection valve 2. The inner branch 10 has a fuel inflow opening 16, which is coaxial with the longitudinal valve axis 15 and which discharges into the fuel conduit 7 of the fuel distributor 1 and connects it to a fuel inlet opening 34 of the fuel injection valve 2.

The wall of the guide conduit 8 has openings 17, one each extending in the region of the valve connection necks 4 parallel to the longitudinal valve axis 1 and discharging into the annular chamber 14; a socket 18 for electrical contact of the various fuel injection valves 2 is disposed in each opening 17 and is connected in turn to the electrical lines 9. At the outlet of the fuel distributor 1 toward the control unit, all the lines 9 are joined to a single contact-making plug 19, which is disposed on a wall of the guide conduit 8 and is electrically connected to a control unit, not shown in further detail, that outputs the electrical pulses for actuating the fuel injection valves 2.

A wall 20 of a cup-shaped connection tang 21 of the fuel injection valve 2 extends into the annular chamber 14 of the fuel distributor 1 and is embodied to fit into the annular chamber 14; it is injection-molded onto the end toward the fuel distributor 1 of a housing 25 of the fuel injection valve 2. The thickness of the wall 20 is less than the width of the annular chamber 14, so that the connection tang 21 extends into the valve connection neck 4 of the fuel distributor 1 with radial clearance on both sides.

On the end of the connection tang 21 toward the fuel distributor 1, a plug 24 that extends parallel to the longitudinal valve axis 15 is injected into the wall 20 of the connection tang 21, on the face end of the part of the wall 20 opposite the socket 18; with the socket 18, the tang 21 forms a separable plug connection 23, which assures the electrical contact of the fuel injection valve 2.

The end of the connection tang 21 toward the fuel distributor 1 is provided on the outer side of the wall 20 with an encompassing groove 26, in which a first elastic sealing element 27, such as an O-ring, is placed; in the installed state of the fuel injection valve 2, the sealing element rests tightly against an inside 29 of the outer branch 11. The inner branch 10, on its end toward the fuel injection valve 2, is provided with a shoulder 28 on which a second elastic sealing element 32, such as an O-ring, is mounted; in the installed state of the fuel injection valve 2, this sealing element rests on the cylindrical inside 35 of the wall 20 and a radially extending bottom 3 of the connection tang 20.

The dimensions of the sealing elements 27, 32 are selected such that the connection of the fuel injection valve 2 with the fuel distributor 1 come about with a slight elastic deformation of the sealing elements 27, 32, so that a tight connection, which compensates for small component tolerances, of the fuel injection valve 2 with the fuel distributor 1 is attained. The fuel injection valve 2 is held in its axial position by the contact of the sealing element 32 with the bottom 33 of the connection tang 21, and in its radial position by the sealing element 27 resting on the inside 29 of the wall 11, so that the valve connection neck 4 and the connection tang 21 are substantially decoupled from one another by the sealing elements 27, 32.

Sealing off of fuel-carrying regions from the guide conduit 8 containing the electrical lines 9 is attained by the sealing element 32. The sealing element 27 seals off the guide conduit 8 and the plug connection 23 from interfering factors from outside, such as splashing water, so that corrosion of the surfaces of the plug connection 23 is avoided, while the sealing element 32 prevents an undesirable escape of fuel from the fuel-carrying region.

For retention of the fuel injection valves 2, two snap springs 38 extending parallel to the longitudinal valve axis 15 are provided on the end of the fuel injection valve 2 toward the fuel distributor 1, for instance on the connection tang 21; on the end, on faces toward one another, each of the snap springs 38 has a locking lug 39 that locks into a respective locking collar 40 disposed on the outside of the branch 11 of the fuel distributor 1 in a suitable position. The snap springs are injection molded, in the form of spring legs 44 diametrically opposite the longitudinal valve axis 15, onto the housing 25 or the connection tang 21 of the fuel injection valve 2, and with the locking collars 40 they form a detent connection 38, 40.

The fuel injection valves 2 must be in an exact position in the circumferential direction, which must not change during either operation or installation; otherwise the desired injection direction of the fuel stream injected by the fuel injection valve, a direction which is necessary for optimum mixture preparation, will be lost. Torsional securing of the fuel injection valve 2 with respect to the fuel distributor 1 is provided by two fixation ribs 46 each, which extend past the locking collar 40 on both sides of it on the outside of the branch 11. The clearance between each fixation rib 46 of a pair corresponds to the width of the spring legs 44, as shown in FIG. 2 of the drawing, so that each spring leg 44, locked into place by its locking lug 39 in the locking collar 40, rests on both sides on a fixation rib 46, and after the fuel injection valve 2 has been locked together with the fuel distributor 1, it can no longer be rotated in the circumferential direction. The position of the fixation ribs 46 is defined in accordance with the requisite orientation of the fuel stream injected by the fuel injection valve 2.

The fuel flows from a fuel supply line, not shown in detail, into the fuel conduit 7 of the fuel distributor 1 and from there on through the various fuel inflow openings 16 into the fuel inlet opening 34 of the applicable fuel injection valve 2; from there, it passes through an injection port 48 into an intake tube, not shown in further detail, of a mixture-compressing internal combustion engine.

The novel fuel distributor is especially well-suited for fuel injection systems of mixture-compressing internal combustion engines with externally supplied ignition, and it enables hydraulic and electrical contacting of the fuel injection valves to the fuel distributor in a single operation.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel distributor for fuel injection systems of mixture-compressing internal combustion engines with externally supplied ignition, for supplying fuel to at least two fuel injection valves, having a fuel conduit and a guide conduit parallel to said fuel conduit for receiving electrical lines; a number of valve connection necks corresponding to the number of fuel injection valves, the fuel injection valves include connection tangs which extend parallel to the longitudinal valve axis of the fuel injection valves which can be inserted into said valve connection means; and an electrical plug connection that comprises a plug (24), the connection tang (21) is cup-shaped and has an annular wall (20) extending concentrically with the longitudinal valve axis (15), said wall at least partly fits into an annular chamber (14) formed by an inner branch (10) and an outer branch (11) of the valve connection neck (4) of the fuel distributor (1).

2. A fuel distributor as defined by claim 1, in which a first elastic sealing element (32) is disposed on a shoulder (28) of the inner branch (10) of the valve connection neck (4) of the fuel distributor (1) and rests on an inside (35) and/or a bottom (33) of the connection tang (21), and that a second elastic sealing element (27) is disposed in an annular groove (26) in the outside of the wall (20) of the connection tang (21) of the fuel injection valve (2) and rests on an inside (29) of the outer branch (11).

3. A fuel distributor a defined by claim 2, in which the plug (24) is disposed in the wall (20) of the connection tang (21) of the fuel injection valve (2), in the region between the sealing elements (27, 32).

4. A fuel distributor as defined by claim 1, in which each valve connection neck (4) and each fuel injection valve (2) are joined to one another by a detent connection (38, 40).

5. A fuel distributor as defined by claim 4 in which said detent connection includes snap springs (38) which include a locking lug (39) that locks into a locking collar (40).

* * * * *